US007779613B2

(12) United States Patent
Tanaka et al.

(10) Patent No.: US 7,779,613 B2
(45) **Date of Patent: *Aug. 24, 2010**

(54) CUSHIONING PACKAGING BODY CONTAINING PACKAGED ARTICLE, AND METHOD AND DEVICE FOR MANUFACTURING THE PACKAGING BODY

(75) Inventors: Mikio Tanaka, Osaka (JP); Daisuke Uratani, Tokyo (JP); Shuji Uda, Toyama (JP)

(73) Assignee: Sun A. Kaken Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/213,954

(22) Filed: Jun. 26, 2008

(65) Prior Publication Data

US 2008/0280744 A1 Nov. 13, 2008

Related U.S. Application Data

(63) Continuation of application No. 10/526,223, filed as application No. PCT/JP03/05603 on May 2, 2003, now Pat. No. 7,404,281.

(30) Foreign Application Priority Data

Sep. 4, 2002 (JP) ..... 2002-259398

(51) Int. Cl.
*B65B 23/00* (2006.01)
*B65D 81/02* (2006.01)

(52) U.S. Cl. ..... 53/472; 53/403; 53/139.5; 206/522; 383/3

(58) Field of Classification Search ..... 53/403, 53/472, 139.5; 206/521, 522; 383/3
See application file for complete search history.

(56) References Cited

U.S. PATENT DOCUMENTS

| | | | |
|---|---|---|---|
| 3,340,669 | A | 9/1967 | James |
| 4,240,556 | A | 12/1980 | Field |
| 4,620,633 | A | 11/1986 | Lookholder |
| 4,877,334 | A | 10/1989 | Cope |
| 5,272,856 | A | 12/1993 | Pharo |
| 5,826,723 | A | 10/1998 | Jaszai et al. |
| 6,283,296 | B1 | 9/2001 | Newman |
| 6,629,777 | B2 | 10/2003 | Tanaka et al. |
| 6,913,803 | B2 | 7/2005 | Peper |
| 7,128,211 | B2 | 10/2006 | Nishi et al. |
| 2005/0109656 | A1 | 5/2005 | Ishizaki |

FOREIGN PATENT DOCUMENTS

| | | | |
|---|---|---|---|
| JP | 5-201427 | A | 8/1993 |
| JP | 3009233 | U | 1/1995 |
| JP | 2002-154579 | A | 5/2002 |
| JP | 2002-255246 | A | 9/2002 |

*Primary Examiner*—Louis K Huynh
(74) *Attorney, Agent, or Firm*—Birch, Stewart, Kolasch & Birch, LLP

(57) ABSTRACT

An apparatus for manufacturing a cushioning package containing an article to be packaged, characterized by comprising an article storage space forming unit that forms an article storage space by overlapping a cushioning sheet that includes small cells that inflates with air filled therein, a sheet adhering unit that adheres the overlapped cushioning sheet together and closes an article storage opening, an article disposing unit that disposes an article to be packaged in the article storage space, and an air-filling unit that fills air in the small cells.

9 Claims, 11 Drawing Sheets

CUSHIONING PACKAGING BODY CONTAINING PACKAGED ARTICLE, AND METHOD AND DEVICE FOR MANUFACTURING THE PACKAGING BODY

CROSS-REFERENCE TO RELATED APPLICATIONS

The present application is a Continuation Application of co-pending U.S. application Ser. No. 10/526,223 filed on Mar. 1, 2005, and for which priority is claimed under 35 U.S.C. §120; and this application claims priority under 35 U.S.C. §119 to International Application No. PCT/JP2003/005603 filed on May 2, 2003 and Japanese Patent Application No. 2002-259398, filed on Sep. 4, 2002, the entire contents of which are hereby incorporated by reference.

BACKGROUND OF THE INVENTION

1. Technical Field

The present invention relates to a cushioning package containing an article to be packaged, to a method of manufacturing it, and to a manufacturing apparatus thereof.

2. Background Art

Conventionally, cushioning packages with a cushioning sheet being able to be filled with air have often been used in order to package an article, such as electrical appliances and parts for machines, which needs to be protected.

For example, FIG. 11 shows a cushioning package 101 that is described by the Official Gazette of Japanese Utility Model Registration No. 3009233. This is a cushioning package having an article storage space 103 sandwiched by a cushioning sheet that is composed of a plurality of small cells 102, and the packaged article 104 disposed in the article storage space 103 is protected by the small cells 102 filled with air.

The above-mentioned cushioning package 101 is, however, one wherein the small cells 102 are filled with air after the article 104 to be packaged has been contained, and because manufacturing of the cushioning package 101 itself, containing of the article 104 and filling the small cells 102 with air cannot be performed at the same time, a complicated process has been required in order to manufacture a cushioning package containing an article to be packaged therein.

Thus, the present invention aims to provide a cushioning package containing an article to be packaged, a method of manufacturing it, and a manufacturing apparatus thereof, which can achieve simultaneous manufacturing of the cushioning package, containing of an article to be packaged and filling the package with air.

SUMMARY AND OBJECTS OF THE INVENTION

In order to solve the above problem, a first aspect of the present invention provides a cushioning package containing an article to be packaged comprising a cushioning sheet 1 constituted of overlapped flexible resin sheets, small cells 11 formed by heat-sealing and dividing the cushioning sheet, an article storage space 1*c* formed by folding the cushioning sheet 1, an article storage opening 1*d*, and an article C to be packaged. The small cells 11 inflates with air filled therein. The article storage space 1*c* is a space enveloped by the small cells 11 and receiving the article C. The article storage opening 1*d* serves as an entrance portion of the article storage space 1*c* and is closed by adhesion after the article C is disposed in the article storage space 1*c* through the opening 1*d*. Filling of air in the small cells 11 is performed during the disposing placing of the article C in the article storage space 1*c* and the closing of the article storage opening 1*d*.

As described above, continuous processes of the disposing of the article C in the article storage space 1*c*, the filling of air in the small cells 11 and the closing of the article storage opening 1*d* can provide a readily manufacturable cushioning package containing an article to be packaged.

In a second aspect of the present invention, as for the above first aspect, provides the cushioning package containing an article to be packaged, wherein the article storage space 1*c* is adhered to be in a hermetic state where an internal pressure of the space is adjusted. The adjustment of the internal pressure is performed by sucking out the air in the article storage space 1*c* or by filling air or gas like an inert gas in the article storage space 1*c*.

As described above, the internal pressure of the article storage space 1*c* in a hermetic status is designed to be adjusted under a positive pressure or a negative pressure in comparison with the outside of the package, thereby being able to manufacture a cushioning package well suited and intended for prevention of insufficient air-filling of the small cells 11, quality preservation of the packaged article C and improvement of total cushioning effect of the package.

A third aspect of the present invention provides a method of manufacturing a cushioning package containing an article to be packaged, wherein a cushioning sheet 1 made of flexible resin sheets that are placed one on another, further heat-sealed and divided into small cells 11, is used. The method comprises the following processes. A first process is to form an article storage space 1*c* by folding the cushioning sheet 1, thus the space is enveloped by the small cells 11. A second process to dispose an article C to be packaged in the article storage space 1*c* through an article storage opening 1*d* that serves as an entry portion of the article storage space 1*c*. A third process to close the article storage opening 1*d* by adhesion while filling air to inflate the small cells 11. The above processes are performed in the recited order.

The above sequential order of the first process to form an article storage space 1*c*, the second process to dispose an article C to be packaged, and the third process to close an article storage opening 1*d* achieves efficient manufacturing of a cushioning package containing an article to be packaged.

A fourth aspect of the present invention, as for the above third aspect, provides the method of manufacturing a cushioning package containing an article to be packaged, wherein the cushioning sheet 1 is an elongated sheet moving in a longitudinal direction through each of said processes. Said first process comprises a step to fold the cushioning sheet 1 in the longitudinal direction and another step to adhere edges of the overlapped cushioning sheet 1 except for a portion that becomes an article storage opening 1*d*.

As described above, since an elongated cushioning sheet 1 is used to manufacture a cushioning package containing an article to be packaged, the cushioning sheet 1 can be readily stored in a roll.

A fifth aspect of the present invention provides an apparatus for manufacturing a cushioning package containing an article to be packaged, wherein the apparatus comprises the following units. An article storage space forming unit 3 forms an article storage space 1*c* by overlapping a cushioning sheet 1 including small cells 11 that inflates with air filled therein. A sheet adhering unit 4 adheres the overlapped cushioning sheets 1. An article disposing unit 5 disposes an article C to be packaged in the article storage space 1*c*. And an air-filling unit 6 that fills the small cells 11 with air.

As described above, a series of units where a cushioning sheet 1 moves through processes the sheet into a cushioning package containing an article to be packaged facilitates manufacturing of the cushioning package containing an article to be packaged.

A sixth aspect of the present invention, as for the above fifth aspect, provides the apparatus for manufacturing a cushioning package containing an article to be packaged, wherein said sheet adhering unit 4 includes a longitudinal-direction seal section 41 for adhering the cushioning sheet 1 in a longitudinal direction and a width-direction seal section 42 for adhering it in a width direction. The longitudinal-direction seal section 41 forms an air passage 15 that communicates with the small cells 11 in the cushioning sheet 1. Said air-filling unit 6 includes an air nozzle 61 of which an air discharge portion 61*a* situated at the top is disposed inside the air passage 15, and a reverse-flow prevention member 62 for directing air inside the air passage 15 to the small cells 11 by pressing the air passage 15. Both the width-direction seal section 42 and the reverse-flow prevention member 62 are provided for a moving body M, which moves depending on the size of the article C along the longitudinal direction of the cushioning sheet 1. After the small cells 11 are filled with air discharged from the air nozzle 61, the moving body M moves downstream together with the cushioning sheet 1 that is subsequently adhered by the width-direction seal section 42 to complete the cushioning package containing the article.

As described above, the nature of the moving body M having a width-direction seal section 42 and a reverse-flow prevention member 62 assists in filling small cells 11 with air, and facilitates manufacturing of the cushioning package containing an article to be packaged.

A seventh aspect of the present invention, as for the above sixth aspect, provides the apparatus for manufacturing a cushioning package containing an article to be packaged, wherein the reverse-flow prevention member 62 is provided at its tip 62*b* with a recess 62*a* that conforms in shape with the cross-sectional shape of the air nozzle 61*a*. The tip 62*b* presses the air passage 15 while the recess 62*a* accepts the air nozzle 61 disposed inside the air passage 15, whereby the air passage 15 is closed except for the portion where the air nozzle 61 is disposed.

As described above, press on the air passage 15 by the tip 62*b* of the reverse-flow prevention member 62 ensures that the air supplied from the air nozzle 61 fills the small cells 11.

An eighth aspect of the present invention, as for the above sixth or seventh aspect, provides the apparatus for manufacturing a cushioning package containing an article to be packaged, wherein the air-filling unit 6 includes an adjusting nozzle 63, the tip of which is disposed in the article storage space 1*c*. The adjusting nozzle 63 includes a means for adjusting the internal pressure of the article storage space 1*c*. Said means is capable of sucking out the air in the article storage space 1*c* or of filling air or gas like an inert gas into the article storage space 1*c*.

As described above, the internal pressure of the article storage space 1*c* is adjusted by the adjusting nozzle 63 under a positive pressure or a negative pressure in comparison with the outside of the package, thereby being able to manufacture a cushioning package well suited and intended for prevention of insufficient air-filling of the small cells 11, quality preservation of the packaged article C and improvement of total cushioning effect of the package.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 2:
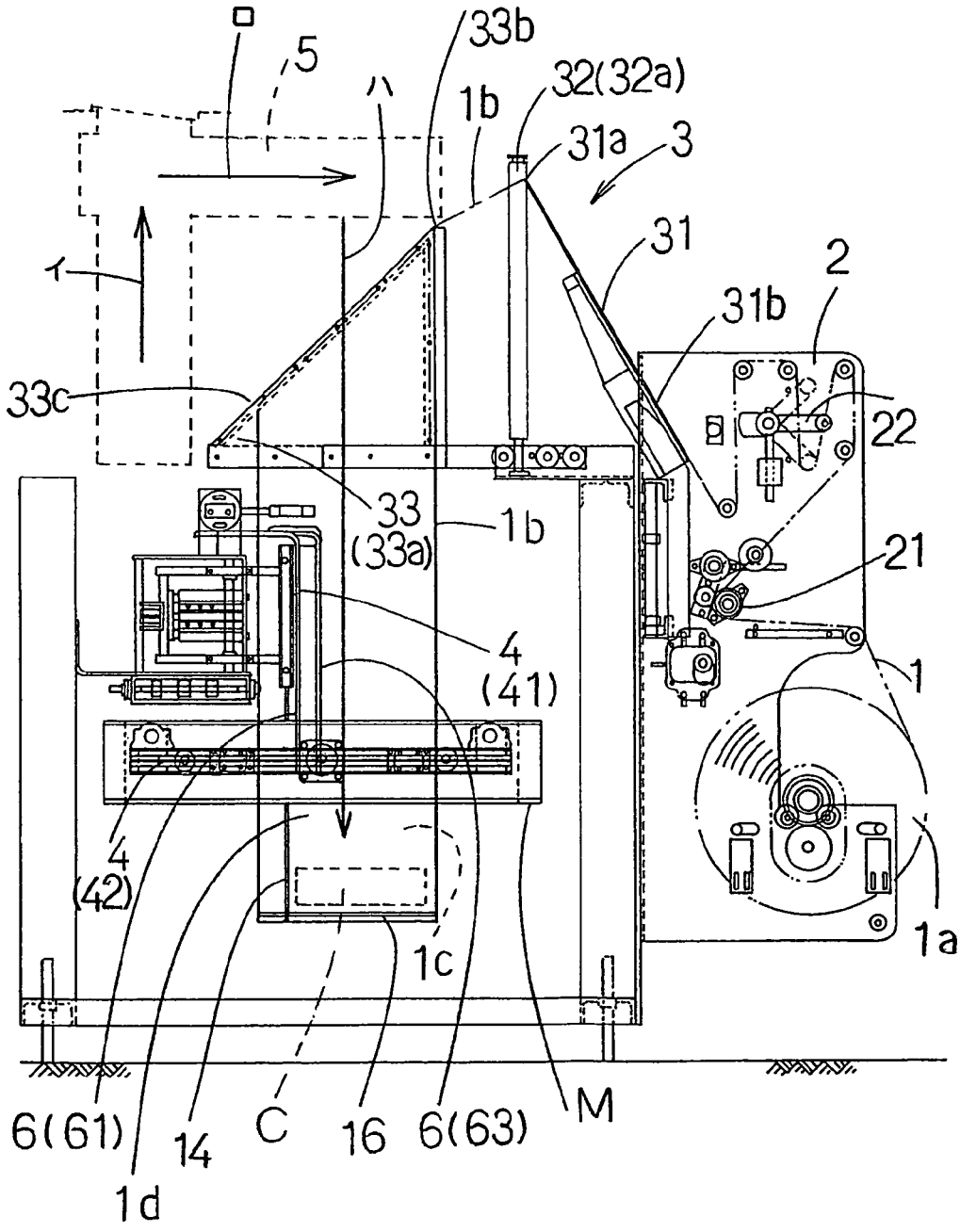
FIG. 2 is an explanatory view showing a manufacturing apparatus according to an example of the present invention from its front, with an article disposing unit excluded therefrom.
Figure 5:
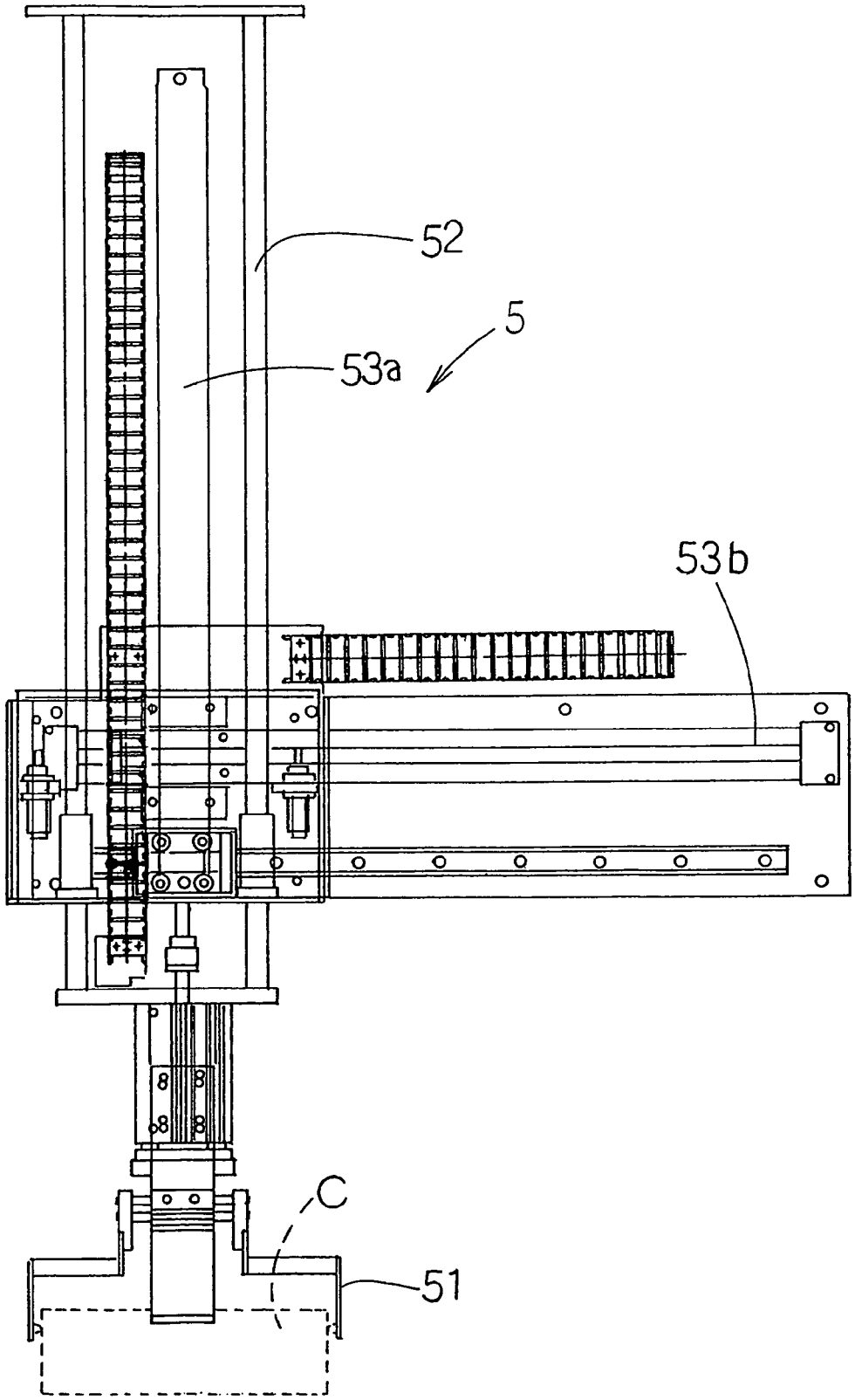
FIG. 5 is an explanatory view showing an article disposing unit in the manufacturing apparatus from its front.
Figure 6:
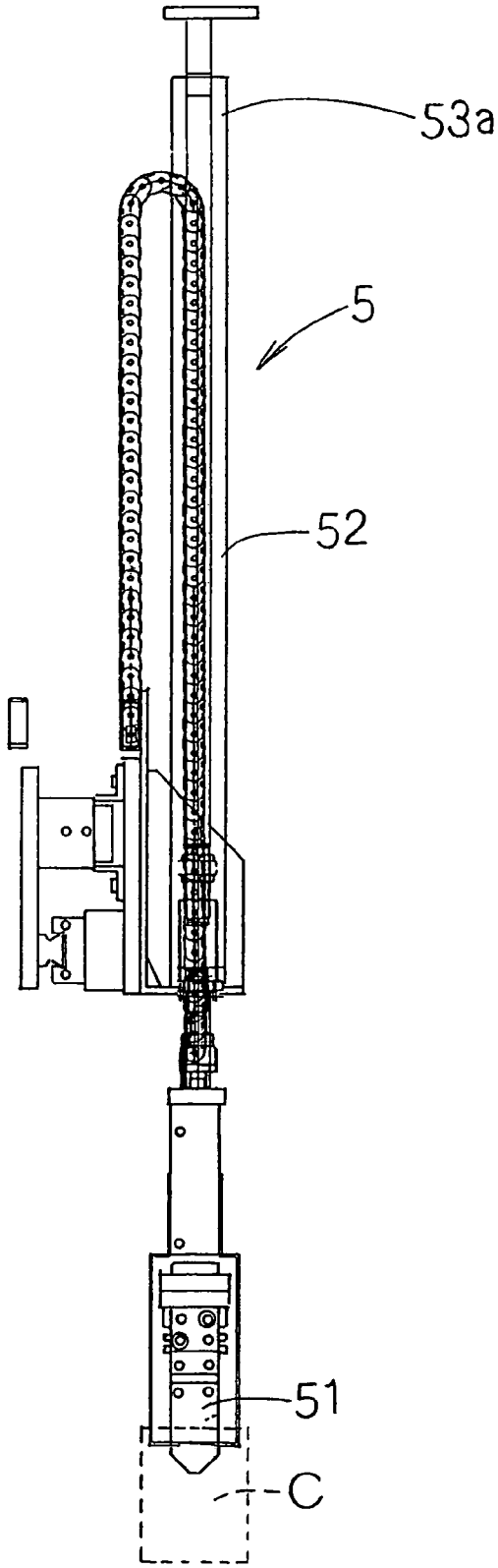
FIG. 6 is an explanatory view showing the same from its left side.
Figure 7:
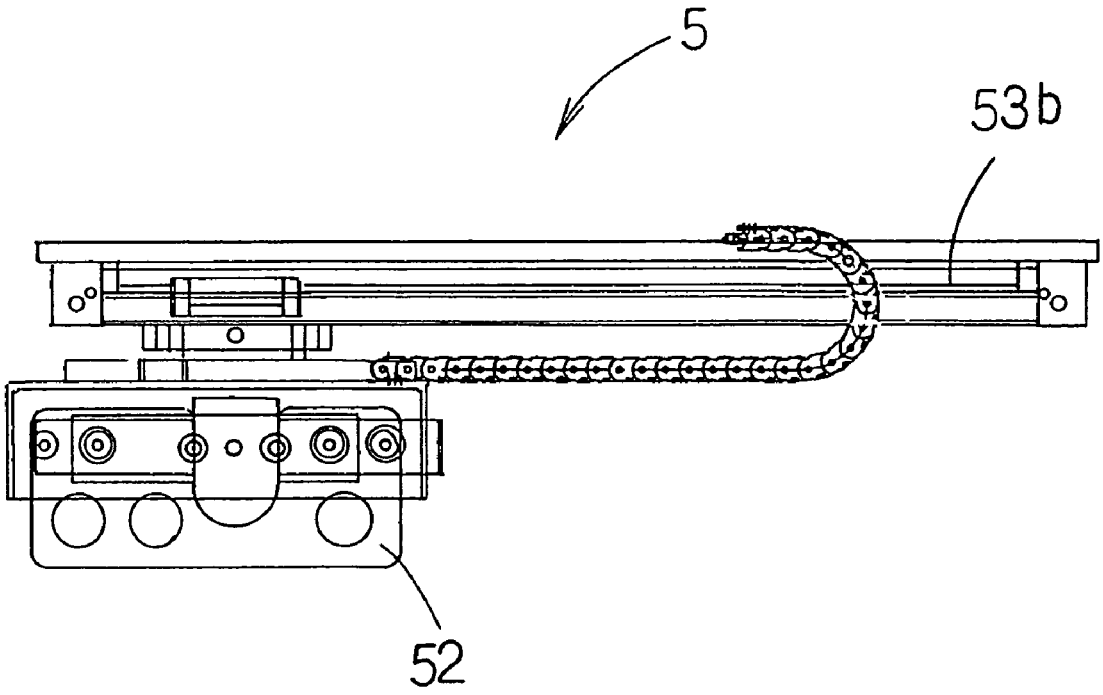
FIG. 7 is an explanatory view showing the same from its plan.

An apparatus for manufacturing a cushioning package containing an article to be packaged is described with reference to the drawings as an example of an embodiment of the present invention. FIG. 2 is an explanatory view showing a manufacturing apparatus of the present example from its front, with an article disposing unit excluded therefrom. FIGS. 5 to 7 are explanatory views showing an article disposing unit.

The manufacturing apparatus of the present example processes an elongated master sheet 1*a* in which small cells 11 have been already formed, wrapping an article C to be packaged, filling the small cells 11 with air, to manufacture a cushioning package containing an article to be packaged.

Figure 1:
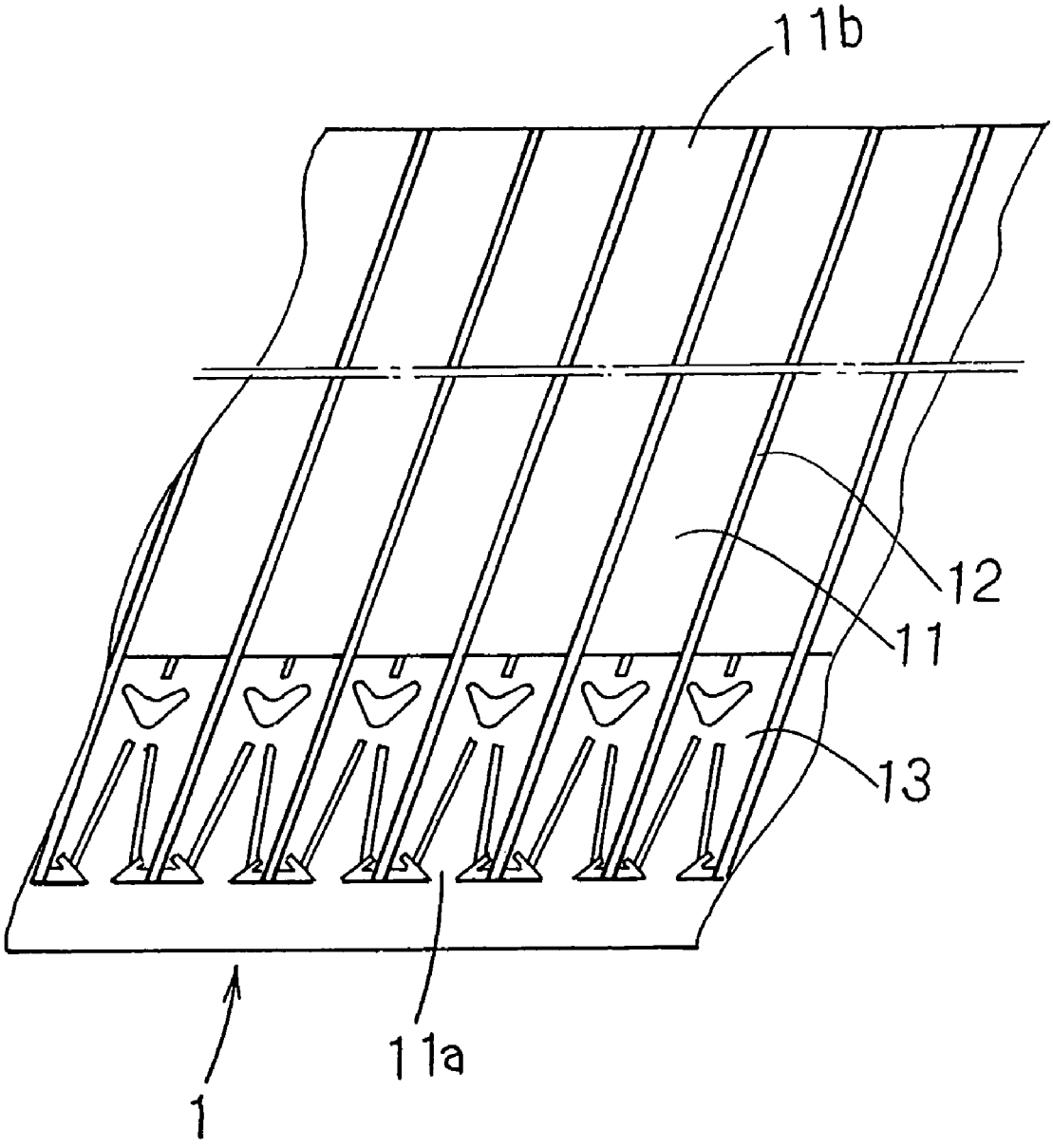
FIG. 1 is a perspective view showing a cushioning sheet in a state of master sheet.

A cushioning sheet 1 used as master sheet 1*a* is constituted of overlapped flexible resin sheets made of polyethylene, nylon or the like that, and is heat-sealed and divided in order to include small cells 11 as shown in FIG. 1. The master sheet 1*a* is an elongated type with the invariable width.

In this embodiment, the small cells 11 are a strip-like shape with bottom seals 12 spaced at equal intervals.

Figure 4:
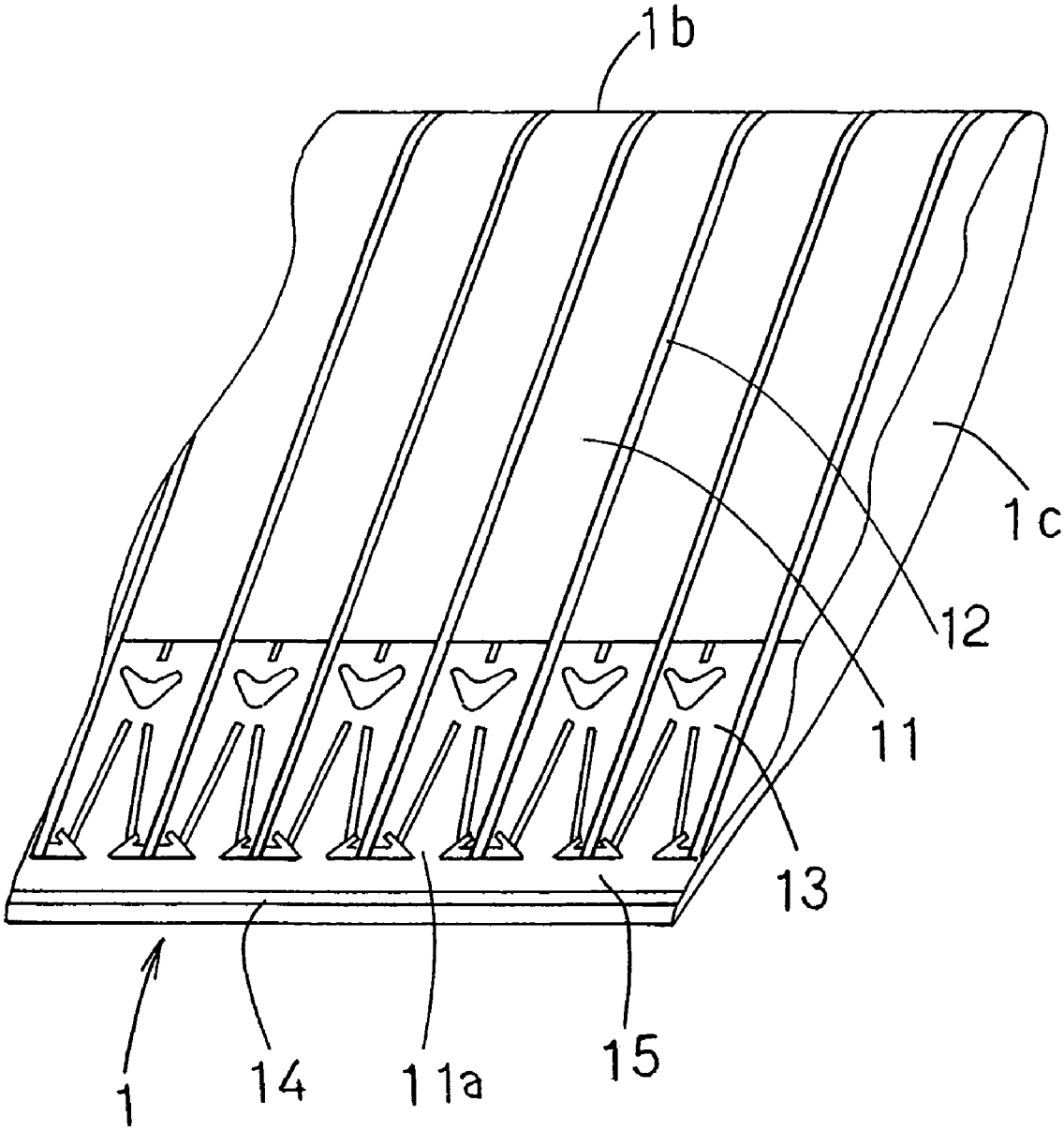
FIG. 4 is a perspective explanatory view showing a cushioning sheet wherein longitudinal direction seals have been formed.

At this stage, each of the small cells 11 in the master sheet 1*a* remains unclosed in a tubular configuration with both lateral ends 11*a*, 11*b* open since a longitudinal seal 14 as shown in FIG. 4 is formed later (by the sheet adhering unit 4).

Also, at one end 11*a* of the small cell 11 is provided a check valve 13 that can prevent a reverse flow of the air filled in the cell 11 not to leak, and admit air into the small cell 11. With the present embodiment, provision of sealing forms a pathway where the sheets are joined together. The structure of the check valve is not limited to this, and more variations in structure may be employed. This check valve 13 is provided as needed, and may be omitted. In the case of the omission of the check valve 13, after the small cells are filled with air, the entrance of small cells 11 and air passages 15 have to be closed by heat-sealing or the like to prevent air from leaking.

The master sheet 1*a* as processed above is wound in a roll as shown in FIG. 2 and set in a most upstream position of the manufacturing apparatus.

The shape of a small cell 11 formed in the master sheet 1*a* is not limited to a strip-like configuration as described above. It is applicable that a circular or oval small cell is formed and each cell is interconnected at an air passage. Or it is applicable that the seal 12 is not formed and the cushioning sheet 1 itself makes a layer of air, i.e. one large cell as a cell 11. Furthermore, even the seals 12 are formed like the present example, the intervals between the seals may be non-uniform as the small cells 11 in a different size are formed.

That is, it is possible to form or shape the small cells 11 as long as they can be filled with air therein.

As shown in FIG. 2, the manufacturing apparatus of the present example comprises a master sheet feeding unit 2, an article storage space forming unit 3, a sheet adhering unit 4, an article disposing unit 5 and an air-filling unit 6. Next, each of said units is described.

It should be noted that, although the following explanation of steps in the manufacturing apparatus of the present example is given in an order, the order of the steps in the present invention should not be construed as being limited to the order of the present example and can be appropriately interchanged and implemented within a possible range. Also, some of the steps may be omitted depending on the case.

The master sheet feeding unit 2 pulls out the master sheet 1*a* wound in a roll and supplies it in a taut state to the units on the downstream side. The sheet feeding adjustment unit also has a drive roller 21 and a tension adjusting arm 22, both of which are driven in conjunction with a moving body M, so that the master sheet 1*a* is pulled out by the length which the sheet is delivered downstream without loosening on the upstream side.

The article storage space forming unit 3 folds the cushioning sheet 1 and forms an article storage space 1*c* by being enveloped by the folded cushioning sheet 1.

In the present example, the article storage space forming unit 3 comprises a bending means 31, a folding means 32 and a reverse bending means 33.

The bending means 31 comprises a central supporting portion 31*a* for supporting a substantial center of the width direction of the cushioning sheet 1 on the downstream side, and a width end supporting portion 31*b* for supporting the vicinity of both ends in the width direction of the cushioning sheet 1 on the upstream side, thereby forming a crease in the substantial center of the width direction of the cushioning sheet 1. Specifically, it is a substantially isosceles-triangular plate seen in plane view, with the vertex (one between equal sides) thereof being the central support portion 31*a* and with the equal sides being the width end supporting portion 31*b*. In this embodiment, the plate is disposed so as to diagonally face upward from the upstream side to the downstream side.

In moving through the bending means 31, the cushioning sheet 1 is bent along the width end supporting portion (each of the equal sides) 31*b*, and consequently given a crease 1*b* on the central supporting portion (the vertex) 31*a* thereof.

The bending means 31 is not limited to a plate as in the present example, and may be a V-shaped rod member only with a vertex and sides of equal length. Moreover, it may support the sheet by the points on the vertex and the vicinity of the ends (not required to be its edge) in the width direction of the cushioning sheet 1. In other wards, as long as crease is formed in the substantial center of the cushioning sheet 1 and the sheet 1 is bent and supported around the width ends not to cause trouble by the curling sheet 1 and affect the following steps, alternatives of the configuration is acceptable.

The folding means 32, a set of two pieces and disposed next on the downstream side to the central supporting portion 31*a* of the bending means 31, folds the cushioning sheet 1 along the crease 1*b*, which is formed as described above, by rollers 32*a*, 32*a* for guiding and holding the sheet 1 therebetween.

In the present example, the rollers 32*a*, 32*a* are vertically placed as shown in FIG. 2, because the crease 1*b* is formed top and both side ends are down of the sheet 1 as the bending means 31 bends the sheet 1.

The reverse folding means 33 comprises a middle-part supporting portion 33*b* for supporting the middle of the cushioning sheet 1 on the upstream side, and a width end supporting portion 33*c* for supporting the vicinity of the ends in the width direction of the cushioning sheet 1 on the downstream side, thereby forming an article storage space 1*c* by folding the sheet 1, which has been folded by the folding means 32, inside out so as to envelop the space.

As shown in FIG. 2, after the master sheet 1*a* placed right and down in the figure moves through the bending means 31 and the folding means 32, both of which are disposed above from the position of the sheet 1 in the figure, the sheet 1 faces transverse. The reverse folding means 33 in the present example is provided to aim to turn the transverse-facing cushioning sheet 1 to face axially, and to easily put an article C to be packaged in the article storage space 1*c* in the sheet 1 in consideration of a layout of the manufacturing apparatus. The means, however, may be omitted. In case the reverse folding means 33 is omitted, a configuration of space enveloped by the folded cushioning sheet 1 after moving through the folding means 32 becomes an article storage space 1*c*.

Figure 3:
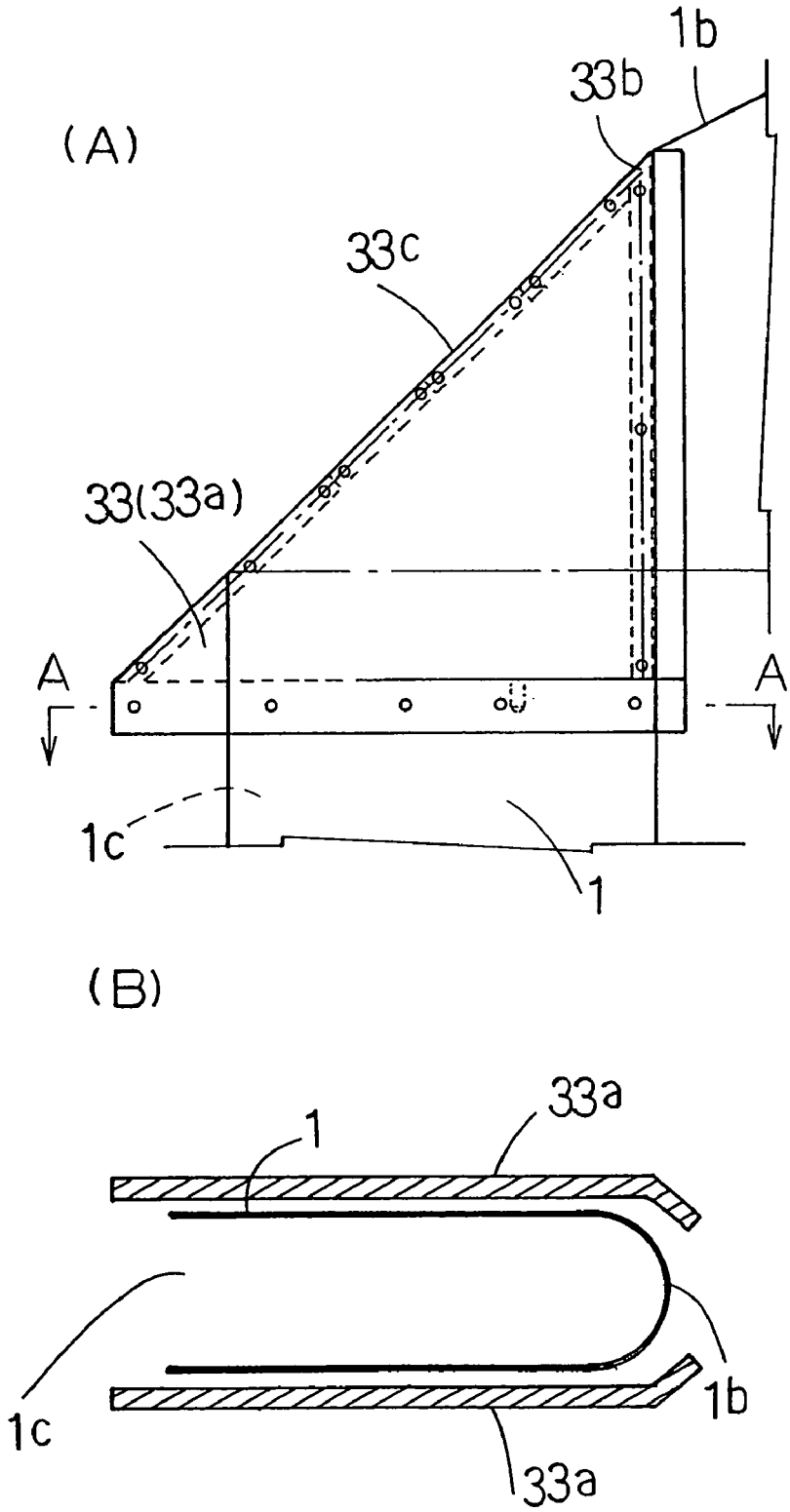
FIG. 3(A) is a major part enlarged explanatory view showing a reverse folding means in the manufacturing apparatus.
FIG. 3(B) is an A-A cross-sectional view of FIG. 3(A)

As shown in FIG. 3(B), a specific structure of the reverse folding means 33 in the present example comprises parallel plates 33*a*, 33*a* between which the cushioning sheet 1 moves. A substantial right-angle isosceles triangle plate in side view is used for the plate 33*a*. The hypotenuse of the triangle serves as the width end supporting portion 33*c* of the plate 33*a*, and, as shown in FIGS. 2 and 3(A), is placed to make the downstream side underneath. Also, one of the vertexes in a high portion of the hypotenuse 33*c* is the middle-part supporting portions 33*b*.

The cushioning sheet 1 with the crease 1*b* positioned upward is placed on the opposing plates 33*a* along the hypotenuse 33*c*. As the sheet 1 moves downward in a manner that the cushioning sheet 1 falls between the plates 33*a*, 33*a*, the crease 1*b* is inverted and the sheet 1 turns inside out.

In this manner, as shown in FIG. 3(B), the cushioning sheet 1 makes a U-shape as following the plates 33*a*, 33*a*, and the space enveloped by the cushioning sheet 1 becomes the article storage space 1*c*.

Here, as the interval between the plates 33*a*, 33*a* of the reverse folding means 33 or the installation position (the left and right directions in FIG. 2) thereof in the manufacturing apparatus leave changeable by fastening with bolts and nuts, the dimensions of bag can change, and alternative types of a cushioning bag can be produced by a single manufacturing apparatus.

The sheet adhering unit 4 adheres the cushioning sheet 1 into which the master sheet 1*a* has been merely folded in order to envelop an article C to be packaged by heat-sealing or the like.

This sheet adhering unit 4 includes a longitudinal-direction seal section 41 and a width-direction seal section 42. The longitudinal-direction seal section 41 is disposed on the downstream side of the reverse folding means 33. This longitudinal-direction seal section 41 is to provide a longitudinal direction seal 14 along the longitudinal direction at the unclosed end side of the U-shaped cushioning sheet 1, as shown in FIG. 3(B), whereby the cushioning sheet 1 is formed cylindrical to envelop the article storage space 1*c*, as shown in FIG. 4.

Also, as the longitudinal direction seal 14 is provided, an air passage 15 is formed between the longitudinal direction seal 14 and the bottom seal 12 that has been already provided on the master sheet 1*a*.

The width-direction seal section 42 disposed for a moving body M, which is described later, is to provide a width direction seal 16 in the width direction of the cushioning sheet 1 in order to close the article storage space 1*c* and the air passage 15.

In the present example, first, a width direction seal 16 for receiving the article C is formed on the end portion of the width side of the cushioning sheet 1, as shown in FIG. 2. The upstream side of the article storage space 1*c* is unclosed at this moment, and the unclosed side has an opening 1*d* serving as an inlet of the article storage space 1*c*. Then, after the article C is put in the article storage space 1*c* through the opening 1*d*, the width direction seal 16 is formed at the opening 1*d* too, thus the article storage space 1*c* is closed.

Seals 14, 16 made in respective directions are not limited to heat-sealing in this example, and sealing method may be changeable such as adhesives and the like. The sealing method can change the configuration of the seal.

Although the seal is provided in a continuous line in this example, a configuration of the seal may be formed with not only a continual dotted line but with a broken line so as to be able to let air flow to communicate inside and outside the article storage space 1*c*.

The article disposing unit 5 comprising a chuck section 51, a movable arm 52 and drive cylinders 53*a*, 53*b* as shown in FIGS. 5 to 7, is disposed above the reverse folding means 33, as represented by a dotted line in FIG. 2.

Each section of the article disposing unit 5 is driven by air pressure, with the movable arm 52 and the drive cylinders 53*a*, 53*b* being coupled together. Thus, the movable arm can be moved. At a lower end of the movable arm 52 is disposed the chuck section 51 in order to grip the article C. For this reason, the chuck section is moved up, down, left and right.

Although the article disposing unit 5 in the present example employs the drive cylinders 53*a*, 53*b*, the present invention is not limited thereto and can employ alternative drive units. When employing a servomotor, for example, the article C can be disposed in the article storage space 1*c* even the configuration of the article C has changed.

Here, a process for disposing the article C, which is at the side of the reverse folding means 33, is explained while making reference to FIG. 2. First, the article C is held by the chuck section 51 and moved up by a vertical direction drive cylinder 53*a* (operation イ a first Japanese letter in order equivalent to A). Then, a horizontal direction drive cylinder 53*b* moves the article right and position it right above the article storage space 1*c* (operation ロ a second Japanese letter in order equivalent to B). Then, the movable arm 52, being moved downward by the vertical direction drive cylinder 53*a*, transfers the article C down to the inside of the article storage space 1*c* and puts it next to the width direction seal 16 which is pre-formed at the end of the downstream side of the cushioning sheet 11 (operation ハ a third Japanese letter in order equivalent to C), and the chuck section 51 spreads to release the article C. Thereafter, the chuck section 51 performs a reverse movement and returns to where it starts operating.

By repeating the above-described operation, an article C to be packed is disposed in the article storage space 1*c* continuously.

As for the air-filling unit 6 in the present embodiment, a pipe nozzle 61 is disposed inside the air passage 15 of the cushioning sheet 1 as shown in FIG. 2. The nozzle 61 extends rightward and curves downward at the position that is further upstream than the longitudinal direction seal section 41, and is fixed to the manufacturing apparatus.

The air supplied from an air-supplying unit (not shown in the figure) such as a compressor is discharged through the nozzle 61 from an air discharge portion 61*a*, which is a tip of the nozzle.

Also, in the present embodiment, an adjusting nozzle 63 that shapes same as the nozzle 61 is disposed parallel to the nozzle 61. A tip of the adjusting nozzle 63 is disposed in the article storage space 1*c* of the cushioning sheet 1.

Here, description is be given of the procedure by which the small cells 11 are filled with air and the cushioning package containing the packaged article is completed with respect to the cushioning sheet 1 of the state where the article C is disposed in the article storage space 1*c* as described above.

The manufacturing apparatus of the present embodiment is provided with a moving body M that vertically moves along the longitudinal direction of the cushioning sheet 1. The moving body M comprises the width-direction seal section 42, an anti-reverse flow member 62 for holding the cushioning sheet 1 in the width direction, and a cutter 7 for cutting the cushioning sheet 1.

Figure 8:
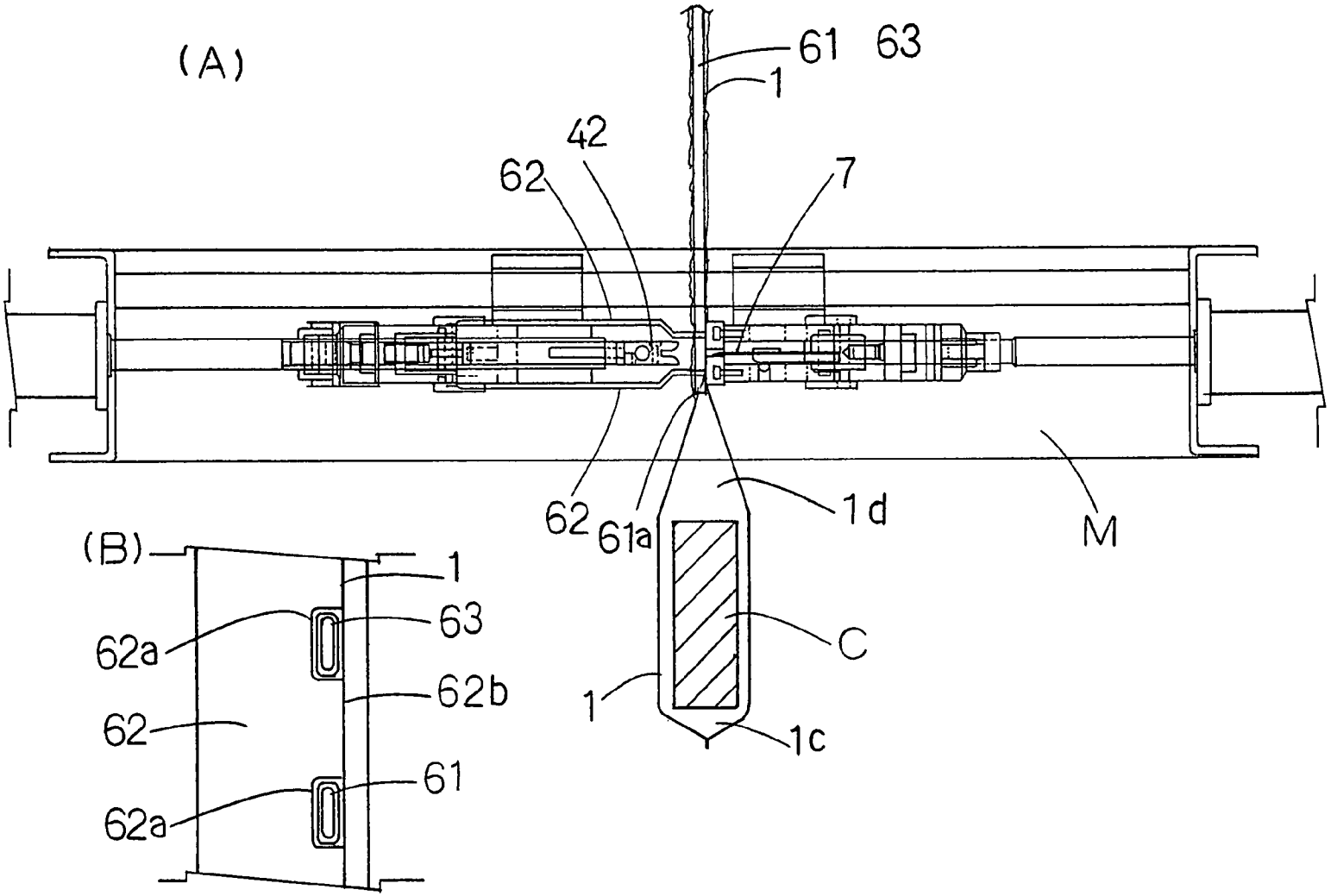
FIG. 8(A) is a major part explanatory view showing a state where the cushioning sheet is filled with air in the manufacturing apparatus according to an example of the present invention.
FIG. 8(B) is an explanatory view showing a reverse-flow prevention member in said apparatus.

As shown in FIG. 8(A), the cushioning sheet 1 with the article C disposed in the article storage space 1*c* is supplied with air which is discharged from the air discharge portion 61*a* of the nozzle 61 disposed in the air passage 15, and the air is filled in the small cells 11 through the air passage 15. At this moment, the anti-reverse flow member 62 is disposed in somewhat further upstream position than the air discharge portion 61*a* of the nozzle 61, holding the cushioning sheet 1. This anti-reverse flow member is a plate member where recesses 62*a*, 62*a* of substantially rectangular or half-oval shape in cross-sectional view as shown in FIG. 8(B) are formed to recess a part of the planar tip 62*b* in the end of the member, and the nozzle 61 and the adjusting nozzle 63 are disposed at the recesses 62*a*, 62*a*. Here, with regard to the nozzle 61, the tip 62*b* presses the air passage 15 of the cushioning sheet 1, whereby the air supplied from the nozzle 61 as described above is prevented from leak and reverse flow in the upstream direction. So is the adjusting nozzle 63.

Here, it is preferable that the nozzle 61, the adjusting nozzle 63 and the shape of the recesses 62*a* have a structure that does not wrinkle the cushioning sheet 1 when the anti-reverse flow member 62 holds the sheet 1. For example, a dimension of the anti-reverse flow member 62 crossing the longitudinal direction makes as short as possible.

Figure 9:
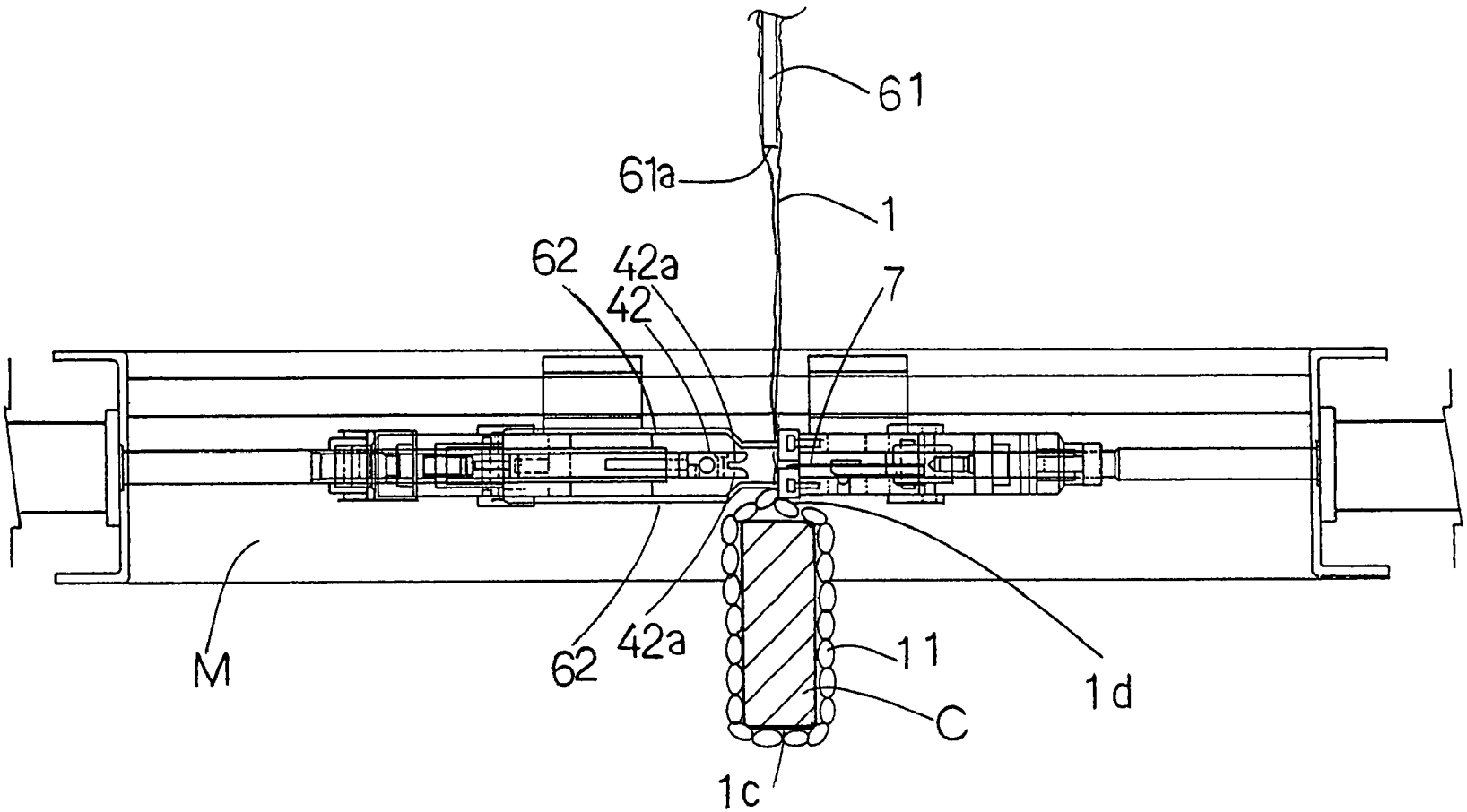
FIG. 9 is a major part explanatory view showing a state where a moving body is moved downward subsequent to filling of the cushioning sheet with air in the manufacturing apparatus.

Next, as shown in FIG. 9, the moving body M moves downward by a predetermined distance. Specifically, it moves by the length equivalent to making one portion of a cushioning package containing an article. Since the anti-reverse flow member 62 still holds the cushioning sheet 1 as described above, the cushioning sheet 1 is also moved downward together with the movement of the moving body M. The master sheet feeding unit 2 is operated in conjunction with this movement so that the master sheet 1*a* is supplied from the roll of master sheet by the length that the moving body M has moved.

The length that the moving body M moves is appropriately adjustable. Thus, a desirable cushioning package can be manufactured that matches the size of an article C to be packaged.

Then, in this state, the width-direction seal 16 is formed at the article storage opening 1*d* by the width-direction seal section 42 and closes the opening. In the width-direction seal section 42, seal bars 42*a*, being an edge portion of abutting against the cushioning sheet 1, are disposed parallel in two rows, whereby the width direction seals 16 are formed parallel in two rows on the sheet 1.

Figure 10:
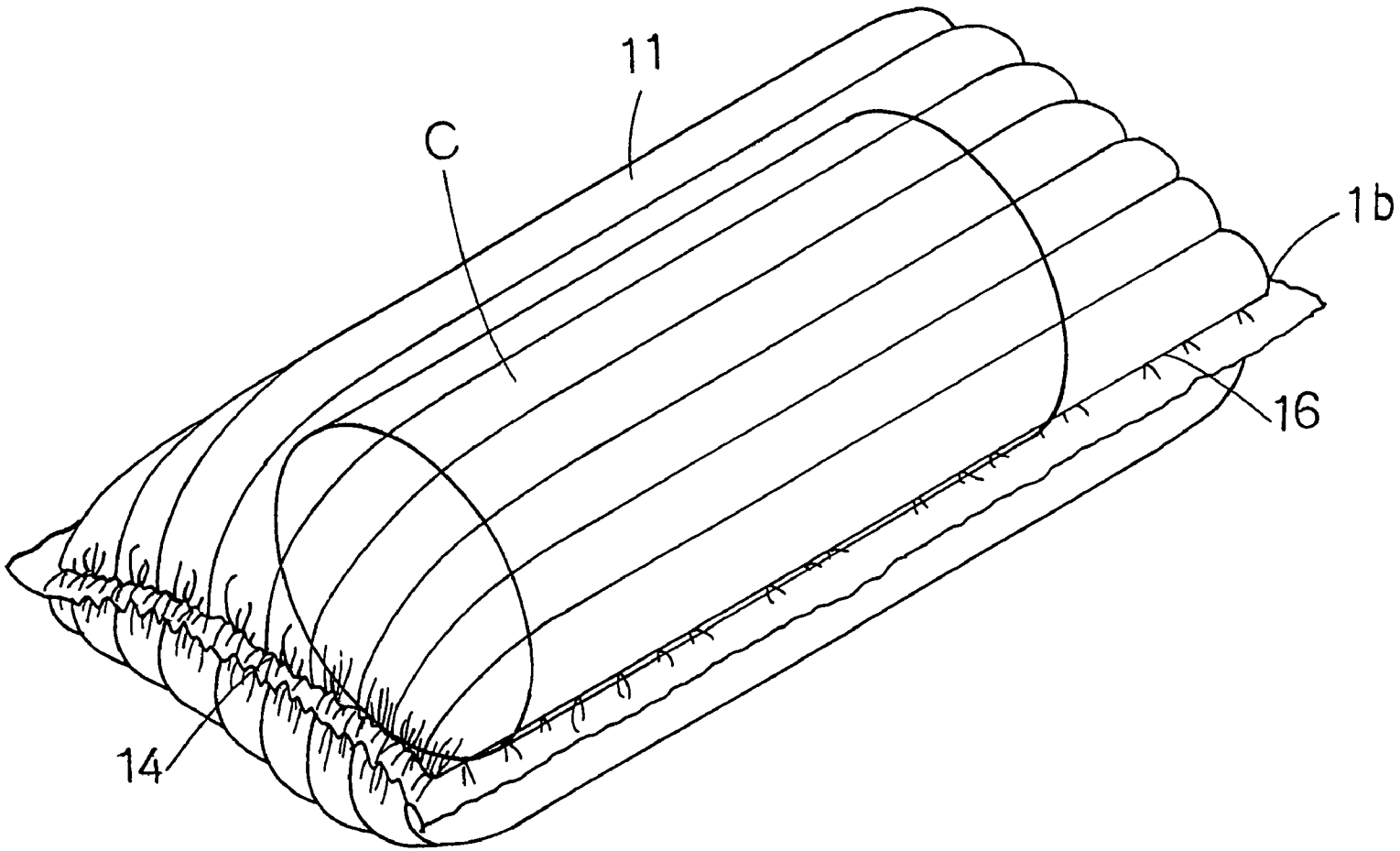
FIG. 10 is a perspective explanatory view showing an example of a cushioning package of the present invention which contains an article to be packaged.
Figure 11:
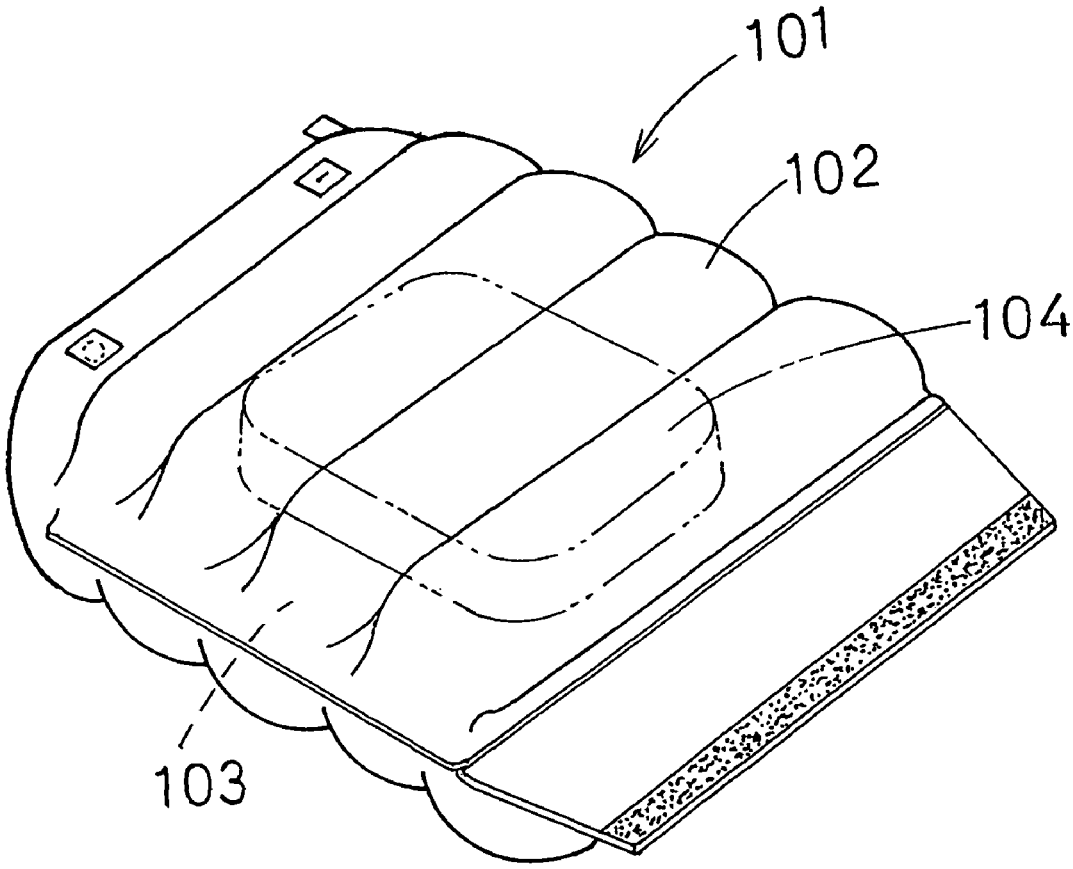
FIG. 11 is a perspective explanatory view showing an example of a conventional cushioning package containing an article to be packaged.

As the article storage opening 1*d* is closed by being formed with the width-direction seals 16, the cutter 7 cuts between the width-direction seals 16 disposed in two rows. Shown in FIG. 10, one portion of cushioning package containing an article to be packaged is completed while the small cells 11 that have been filled with air envelops the article C to be packaged.

The manufacturing step comprising each of the aforementioned units is sequentially proceeded in the present invention, so a cushioning package containing an article to be packaged can be efficiently manufactured.

Here, the function of the adjusting nozzle 63 will be described.

Referring to filling of the small cells 11 with air, when the air discharge portion 61*a* of the nozzle 61 discharges air while the cushioning sheet 1 is pressed by the above-described reverse-flow prevention member 62, the small cells 11 are filled with the air and the inflated small cells 11 as shown in FIG. 9 press the article storage space 1*c*. This is because the article storage space 1*c* in the present embodiment is in a sealed state by the longitudinal direction seal 14, the fold 1*b*, the width direction seals 16 and the press of the reverse-flow prevention member 62. Because of this, a check valve 13 is pressed and the air flowing from the air passage 15 to the small cells 11 stops, resulting in insufficient air-filling of the small cells 11.

The internal pressure of the article storage space 1*c* is adjusted by sucking out the air inside the sealed article storage space 1*c* through the adjusting nozzle 63 disposed in the sealed article storage space 1*c*, which can prevent said insufficient air-filling.

As for different use of the adjusting nozzle 63, in the case the packaged article C may rust or deteriorate due to humidity or exposure of air, deaeration of the article storage space 1*c* is done via the adjusting nozzle 63 before filling an inert gas such as nitrogen gas into the article storage space 1*c* to preserve the product quality of the packaged article C.

Adoption of nylon which excellently blocks air for the cushioning sheet 1 and a hermetic state of the article storage space 1*c* by sealing the cushioning sheet 1 with the heat seal 14, 16 prevents outflow of the inert gas from the inside and inflow of air from the outside, preserving the product quality of the packaged article C over a long period of time.

Dual cushioning effect can be achieved by filling the article storage space 1*c* with air from the adjusting nozzle 63 after the small cells have been already inflated to provide a cushioning effect to the article storage space 1*c* itself together with the small cells 11. This may improve the cushioning effect of the entire cushioning package.

Thus, by adjusting the internal pressure of the article storage space 1*c* to a positive pressure or a negative pressure in comparison with the outside, a cushioning package that is well suited for the intended use can be made.

In the present embodiment, the small cells 11 are filled with air before the article storage opening 1*d* is closed by forming the width-direction seal 16. As for the order, the width-direction seal 16 may be formed first or simultaneously where the article storage space 1*c* does not have to be in a sealed state because the cushioning sheet 1 contains a check valve 13.

The embodiment of the present invention is not limited to the above-described embodiment and can be varied.

For example, instead of folding a single cushioning sheet 1 as in the present embodiment, all four sides of the opposing cushioning sheets 1 or three sides other than one longitudinal direction side or the two width direction sides of two opposing cushioning sheets 1 may be adhered to form the article storage space 1*c*. With all four sides adhered, a completely sealed cushioning package is formed. With three sides other than one longitudinal direction side adhered, a cushioning package having one opening is formed. With the two width direction sides adhered, a sleeve-type cushioning package is formed.

In conjunction with the foregoing processes, forming small cells 11 and mounting a check valve 13 may be carried out during a series of the processes on a blank resin sheet where any process has not been applied.

Also, instead of forming the article storage space 1*c* and then disposing the article C in the article storage space 1*c* as in the present embodiment, the article C may be disposed on the master sheet 1*a*, i.e. spread cushioning sheet 1, before the packaging and filling of the small cells 11 with air.

When a cushioning package containing an article is formed by a series of steps as described above, the invention can be implemented by variously changing the procedure of the steps and the processing method within the scope of the present invention.

The present invention has the following excellent effects.

In the first aspect of the present invention, continuous processes of the disposing of the article C in the article storage space 1*c*, the filling of air in the small cells 11 and the closing of the article storage opening 1*d* can provide a readily manufacturable cushioning package containing an article to be packaged.

In the second aspect of the present invention, in addition to the effect of the first aspect, an internal pressure of the article storage space 1*c* in a hermetic state is designed to be adjusted under a positive pressure or a negative pressure in comparison with the outside of the package, thereby being able to manufacture a cushioning package well suited and intended for prevention of insufficient air-filling of the small cells 11, quality preservation of the packaged article C and improvement of total cushioning effect of the package.

In the third aspect of the present invention, the sequential order of the first process to form an article storage space 1*c*, the second process to dispose an article to be packaged in the article storage space 1*c*, and the third process to close an article storage opening 1*d* achieve efficient manufacturing of a cushioning package containing an article to be packaged.

In the fourth aspect of the present invention, in addition to the effect of the third aspect, since an elongated cushioning sheet 1 is used to manufacture a cushioning package containing an article to be packed, the cushioning sheet 1 can be readily stored in a roll.

In the fifth aspect of the present invention, a series of units to process a cushioning sheet 1 into a cushioning package containing an article to be packaged facilitate manufacturing of a cushioning package containing an article.

In the sixth aspect of the present invention, in addition to the effect of the fifth aspect, the nature of the moving body M having a width-direction seal section 42 and a reverse-flow prevention member 62 assists in filling the small cells with air, and facilitates manufacturing of the cushioning package containing an article to be packaged.

In the seventh aspect of the present invention, in addition to the effect of the sixth aspect, press on an air passage 15 by a tip 62*b* of the reverse-flow prevention member 62 ensures that the air supplied from the air nozzle 61 fills the small cells 11.

In the eighth aspect of the present invention, in addition the effects of the sixth or seventh aspect, the internal pressure of the article storage space 1*c* is adjusted by an adjusting nozzle 63 under a positive pressure or a negative pressure in comparison with the outside of the package, thereby being able to manufacture a cushioning package well suited and intended for prevention of insufficient air-filling of the small cells 11, quality preservation of the packaged article C and improvement of total cushioning effect of the cushioning package.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of manufacturing a cushioning package containing an article to be packaged, said method comprising the steps of:

using a cushioning sheet made of flexible resin sheets that are placed one on another, heat-sealed and divided into a group of independent small cells in the shape of a strip;

forming an article storage space by folding the cushioning sheet at a point that is substantially midway between opposite ends of the small cells in a direction transverse to a longitudinal direction of the small cells along a crease, the space being enveloped by the small cells, and a side of the cushioning sheet opposite to the crease being open;

disposing an article to be packaged in the article storage space through an article storage opening that serves as an entry portion of the article storage space; and closing the article storage opening by adhesion while filling air from one side of an end of each of the small cells to inflate the small cells that the crease crosses, whereby the cushioning package so formed includes one outer edge which is folded in a U-shape at the crease and is not closed by adhesion, and another outer edge formed by being closed by adhesion, except for said one outer edge;

wherein the steps of forming, disposing, and closing are performed in the recited order.

2. An apparatus for manufacturing a cushioning package containing an article to be packaged, comprising:

an article storage space forming unit in which a cushioning sheet made of flexible resin sheets that are placed one on another, heat-sealed and divided into a group of independent small cells formed in the shape of a strip, is folded in a U-shape along a crease that crosses the small cells at a point that is substantially at a midway between opposite ends of the small cells, whereby an article storage space is formed, the article storage space being enveloped by the small cells, and a side opposite to the crease being open;

wherein the folded cushioning sheet done by the article storage space forming unit has a shape of a belt with an invariable width, and the crease being formed along a first of two outer edges extending in a longitudinal direction of the folded cushioning sheet;

a sheet adhering unit that adheres a second of the two outer edges extending in a longitudinal direction of the overlapped cushioning sheet and the width direction of the cushioning sheet in a manner to sandwich the article storage space, while the first outer edge of the overlapping sheet extending in the longitudinal direction of the folded cushioning sheet, the outer edge being folded and not adhered;

an article disposing unit that disposes an article to be packaged in the article storage space; and an air-filling unit that fills air from the open side of each of the small cells, wherein said sheet adhering unit includes a longitudinal-direction seal section for adhering the cushioning sheet in a longitudinal direction, and a width-direction seal section for adhering the cushioning sheet in a width direction, and the longitudinal-direction seal section forms an air passage that communicates with the small cell in the cushioning sheet, and said air-filling unit includes an air nozzle having an air discharge portion situated at a tip thereof, the air nozzle being disposed inside the air passage, and a reverse-flow prevention member for directing air inside the air passage to the small cells by pressing the air passage, and both the width-direction seal section and the reverse-flow prevention member are disposed on a moving body, the moving body moving along the longitudinal direction of the cushioning sheet depending on the size of the article, wherein, after the small cells are filled with air discharged from the air nozzle, the moving body moves downstream together with the cushioning sheet that is subsequently adhered by the width-direction seal section to complete the cushioning package containing the article.

3. An apparatus for manufacturing a cushioning package containing an article to be packaged, as in claim 2, wherein the reverse-flow prevention member is provided at a tip thereof with a recess that conforms in shape to the cross-sectional shape of the air nozzle, and the tip presses the air passage while the recess accepts the air nozzle disposed inside the air passage, whereby the air passage is closed except for a portion where the air nozzle is disposed.

4. The apparatus for manufacturing a cushioning package containing an article to be packaged, as in claim 2, wherein the air-filling unit includes an adjusting nozzle, a tip of the adjusting nozzle being disposed in the article storage space, and the adjusting nozzle includes an adjusting mechanism that adjusts an internal pressure of the article storage space, and, in said adjusting mechanism, the adjusting nozzle is inserted into the article storage space through the article storage opening that serves as an entrance portion of the article storage space, whereby the air filling unit is capable of sucking out air in the article storage space or filling air or inert gas in the article storage space.

5. An apparatus for manufacturing a cushioning package containing an article to be packaged, comprising:

an article storage space forming unit in which a cushioning sheet made of flexible resin sheets that are placed one on another, heat-sealed and divided into a group of independent small cells formed in the shape of a strip, is folded in a U-shape along a crease that crosses the small cells at a point that is substantially at a midway between opposite ends of the small cells, whereby an article storage space is formed, the article storage space being enveloped by the small cells, and a side opposite to the crease being open;

wherein the folded cushioning sheet done by the article storage space forming unit has a shape of a belt with an invariable width, and the crease being formed along a first of two outer edges extending in a longitudinal direction of the folded cushioning sheet;

a sheet adhering unit that adheres a second of the two outer edges extending in a longitudinal direction of the overlapped cushioning sheet and the width direction of the cushioning sheet in a manner to sandwich the article storage space, while the first outer edge of the overlapping sheet extending in the longitudinal direction of the folded cushioning sheet, the outer edge being folded and not adhered;

an article disposing unit that disposes an article to be packaged in the article storage space; and an air-filling unit that fills air from the open side of each of the small cells, wherein the air-filling unit includes an adjusting nozzle, a tip of the adjusting nozzle being disposed in the article storage space, and the adjusting nozzle includes an adjusting mechanism that adjusts an internal pressure of the article storage space, and, in said adjusting mechanism, the adjusting nozzle is inserted into the article storage space through the article storage opening that serves as an entrance portion of the article storage space, whereby the air filling unit is capable of sucking out air in the article storage space or filling air or inert gas in the article storage space.

6. A cushioning package containing an article to be packaged comprising:

a cushioning sheet comprising overlapped flexible resin sheets, the cushioning sheet including a group of independent small cells formed in the shape of a strip by heat-sealing and dividing the cushioning sheet, the heat-sealing and dividing forming a closed space in each of the small cells, and each of the small cells being capable of inflating when air is filled therein;

an article storage space formed by folding the cushioning sheet along a crease crossing said small cells, the crease being transverse to a longitudinal direction of the small cells;

an article storage opening; and an article to be packaged, wherein the article storage space is a space enveloped by the small cells and receiving the article therein, and wherein the crease is transverse to a longitudinal direction of the small cells at a point that is sufficiently at a midway between opposite ends of the small cells, and wherein the crease is one of outer edges of the folded cushioning sheet of the overlapped sheets, and, except for the outer edge which is the crease, each of the outer edges of the folded cushioning sheet is adhered, thus closing the article storage space, and wherein the article storage opening serves as an entrance portion of the article storage space for the article to be packaged and is closed by adhesion of said outer edges of the folded cushioning sheet after the article is disposed in the article storage space through the article storage opening, and wherein filling of air in the small cells that the crease crosses is performed from one end of each of the small cells after the disposing of the article in the article storage space.

7. The cushioning package containing an article to be packaged as in claim 6, wherein outer edges are bonded in said manner, whereby the article storage space is sealed to be in a hermetic state where an internal pressure of the space is adjusted, and wherein an adjustment of the internal pressure is performed through the article storage opening by sucking out air in the article storage space or by filling air or an inert gas in the article storage space prior to the closing of the article storage opening.

8. The cushioning package containing an article to be packaged as in claim 6, wherein the folded cushioning sheet has a shape that is substantially rectangular, and the crease being formed along a first of four outer edges of the folded cushioning sheet, and wherein the outer edges of the folded cushioning sheet are bonded together except for the first outer edge of the folded cushioning sheet which is folded and not bonged.

9. The cushioning package containing an article to be packaged as in claim 6, wherein filling of air in the small cells that the crease crosses is performed only from the one end of each of the small cells.

* * * * *